United States Patent [19]

Koenig et al.

[11] Patent Number: 4,653,067

[45] Date of Patent: Mar. 24, 1987

[54] CURRENT FEED FOR AN ELECTRODE OF AN ELECTRIC SMELTING FURNACE

[75] Inventors: Heribert Koenig, Duisborg; Heinz Stark, Essen, both of Fed. Rep. of Germany

[73] Assignee: Mannesmann Aktiengesellschaft, Duessoldorf, Fed. Rep. of Germany

[21] Appl. No.: 741,345

[22] Filed: Jun. 5, 1985

[30] Foreign Application Priority Data

Jun. 5, 1984 [DE] Fed. Rep. of Germany ..... 3421327

[51] Int. Cl.[4] ..... H05B 7/11

[52] U.S. Cl. ..... 373/101

[58] Field of Search ..... 373/101, 94, 96, 99, 373/102

[56] References Cited

U.S. PATENT DOCUMENTS

| | | | |
|---|---|---|---|
| 2,446,002 | 7/1948 | Fausek et al. | 373/101 |
| 2,477,077 | 7/1949 | Moore | 373/101 |
| 4,326,093 | 4/1982 | Persson | 373/101 |

*Primary Examiner*—Roy N. Envall, Jr.

*Attorney, Agent, or Firm*—Oblon, Fisher, Spivak, McClelland & Maier

[57] ABSTRACT

A current feed for an electrode of an electric smelting furnace. The current feed conductors lead to the electrode above the furnace hearth, and a current feed element surrounds the electrode and is arranged coaxially to the electrode and concentrically to the current feed conductors. Contact jaws are arranged concentrically to the electrode. The current-conducting cross section of the current feed element varies continuously from a maximum on the side away from the furnace axis to a minimum on the side adjacent to the furnace axis.

10 Claims, 5 Drawing Figures

(A-B)

(C-D)

CURRENT FEED FOR AN ELECTRODE OF AN ELECTRIC SMELTING FURNACE

FIELD OF THE INVENTION

This invention relates to a current feed for an electrode of an electric smelting furnace. The current feed conductors lead to the electrode above the furnace hearth, and a current feed element surrounds the electrode and is arranged coaxially to the electrode and concentrically to the current feed conductors. Contact jaws are arranged concentrically to the electrode.

BACKGROUND OF THE INVENTION

From FR-PS 967,995 a current feed is known that conveys current to the electrode by an annular current feed element and a cooling jacket with contact jaws. The current feed element has the same ohmic resistance in all cross sections. With this arrangement of the current feed for the electrodes of an electric smelting furnace in the area of the hearth, there is the disadvantage that the current in the electrode and in the current feed element is pushed in the direction of the furnace center. This leads to thermal overloading of individual current conductors and current feed conductors or to an uneconomical higher-grade design of the less-loaded conductors. Additionally, in this arrangement the current is unevenly fed to the electrode over the contact jaws. This leads to wear and tear on the contact jaws and also to possible damage to the electrode.

OBJECT OF THE INVENTION

The object of the invention is to avoid the above-described disadvantages and to equalize the uneven distribution of the electric current in the current conductors by ohmic measures.

SUMMARY OF THE INVENTION

The current-conducting cross section of the current feed element according to the subject invention is designed to counter the uneven distribution of the electric current caused by skin and proximity effects. The part of the current feed element with the largest current-conducting cross section running concentrically at a distance around the electrode is placed on the side of the electrode turned away from the furnace center. Because of less ohmic resistance, the electric current will flow preferentially through the part of the current feed element with the largest current-conducting cross section. The distribution of the electric current, on account of the ohmic measures, counters the distribution occurring by skin and proximity effects, so that the current feed by current conductors and contact jaws to the electrode is evened out. The evening out of the current feed to the electrode avoids overloading of individual current conductors and contact jaws and thus possible damage to the electrode.

A further advantage of the invention is the reduction of dissipation that occurs because of partially increased heating of the electrode on account of uneven current distribution. In case of a smaller maximum current of the current-conducting electrode, a smaller wire cross section is required with the same furnace load.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PRESENTLY PREFERRED EMBODIMENTS

Figure 1:
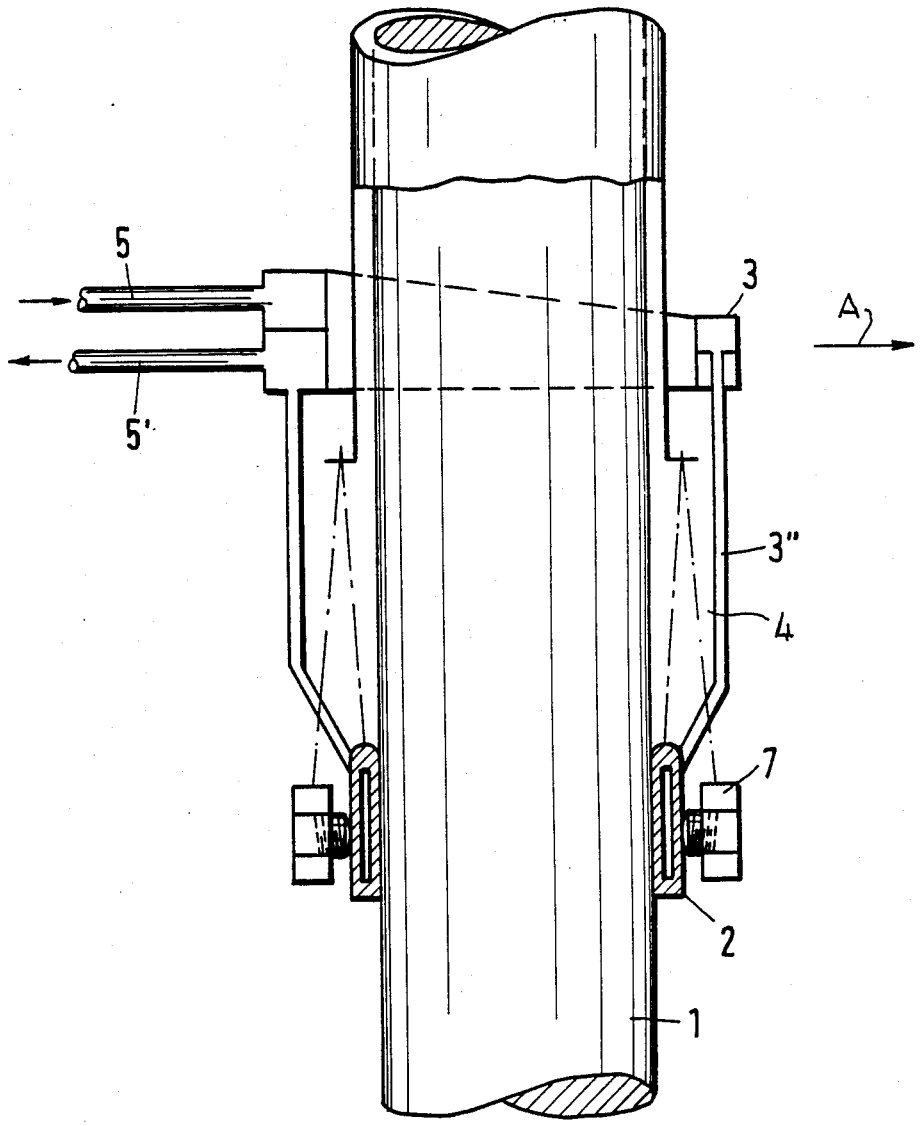
FIG. 1 is a longitudinal view, partially in cross section, of a first embodiment of a current feed element.
Figure 2:
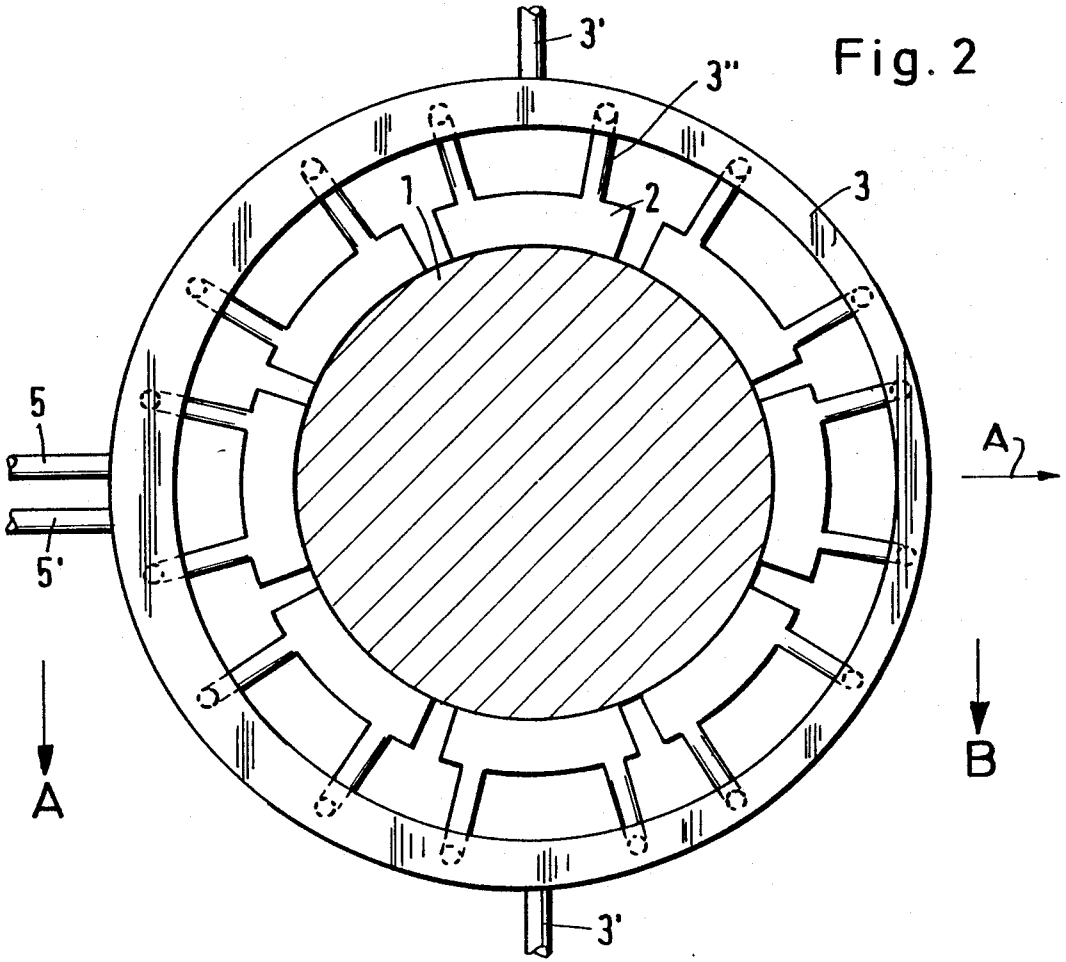
FIG. 2 is a cross-sectional view of the current feed element shown in FIG. 1.

FIGS. 1 and 2 show an electrode 1 around which a current feed element 3 is concentrically arranged at a distance from the electrode 1. The electrode 1 is one of three electrodes in a conventional triangular arrangement in an electric melting furnace, and the arrow A indicates the direction of the axis of the triangular arrangement. The current feed element 3 consists of a hollow section with constant wall thickness. As shown in FIG. 2, current feed conductor 3' are radially arranged on the current feed element 3. One end of each of a plurality of current conductors 3'' is fastened to the part of each current feed element 3 turned away from the hearth, and the other end of each current conductor 3'' is fastened to one of a plurality of contact jaws 2 placed around the electrode 1. As is indicated by the dash lines in FIG. 1, the current feed element 3 has a larger current-conducting cross-section on the side remote from the furnace axis (i.e., away from the direction indicated by the arrow A) than on the side adjacent to the furnace axis. The current conductors 3'' are all the same length, and each current conductor 3'' is predominantly parallel to the axis of the electrode 1 at a distance from the electrode 1.

The contact jaws 2 are pressed against the electrode 1 by means of clamping elements 7. The dot-dash lines 4 indicate the suspensions for the contact jaws 2 and the clamping elements 7. However, the suspensions are not shown in detail, since they may be conventional. Feeding of a cooling medium for cooling of the current feed element 3 takes place by a water intake 5 and a water discharge 5'.

Figure 3:
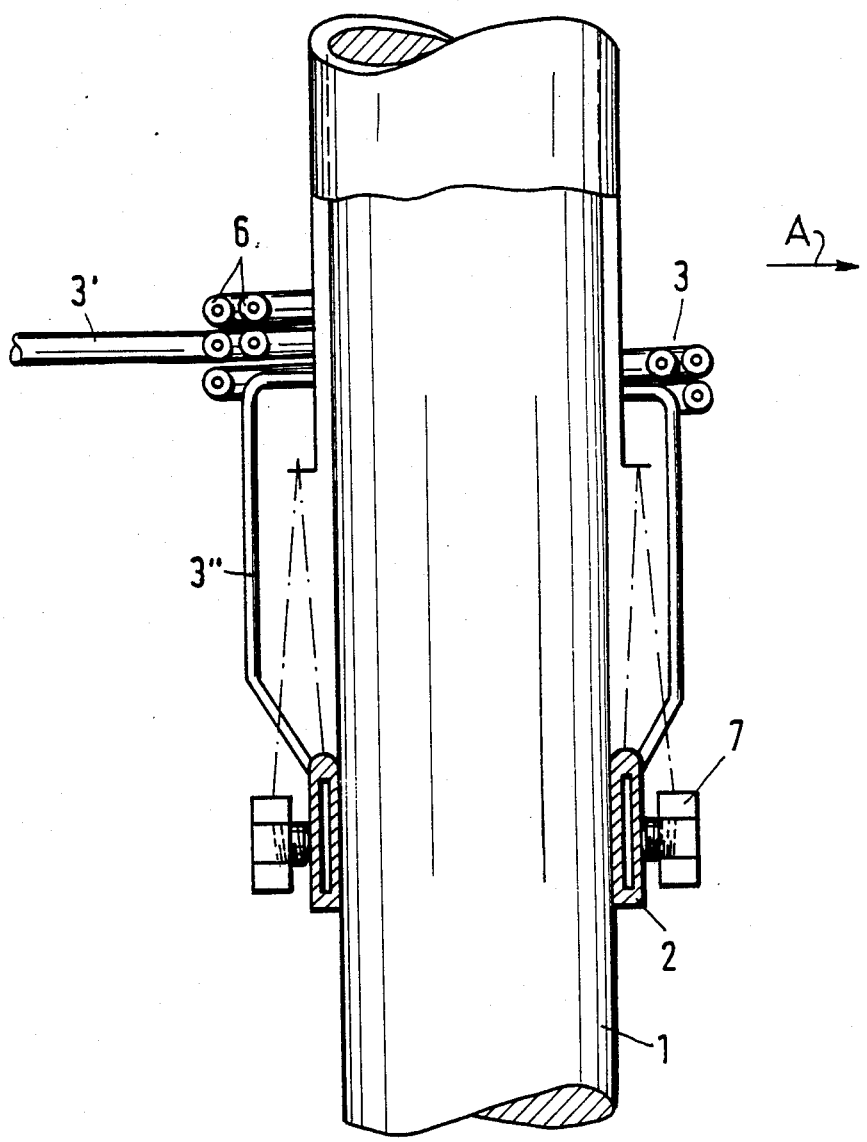
FIG. 3 is a longitudinal view, partly in cross section, of a second embodiment of a current feed element.
Figure 4:
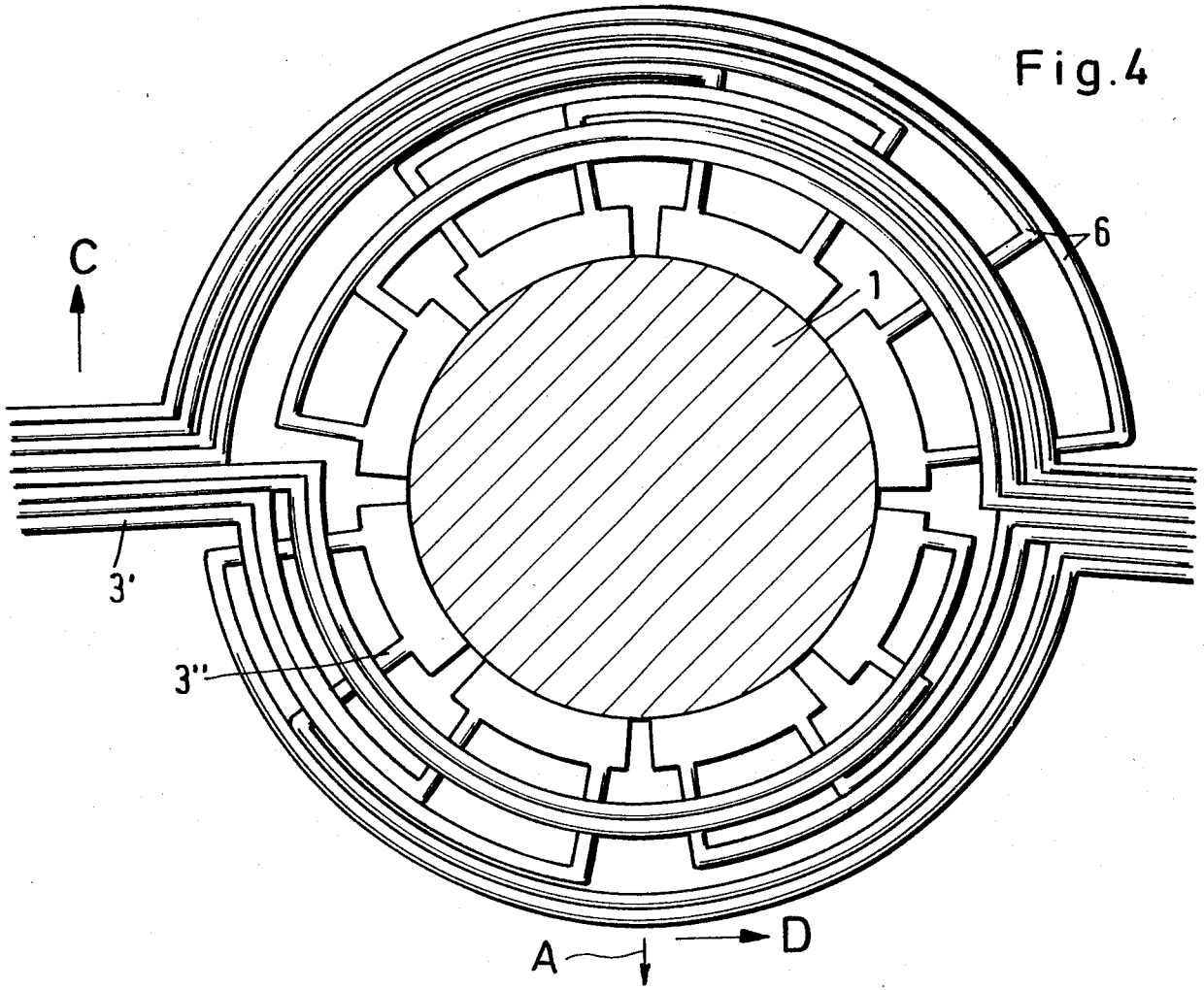
FIG. 4 is a cross-sectional view of the current feed element shown in FIG. 3.
Figure 5:
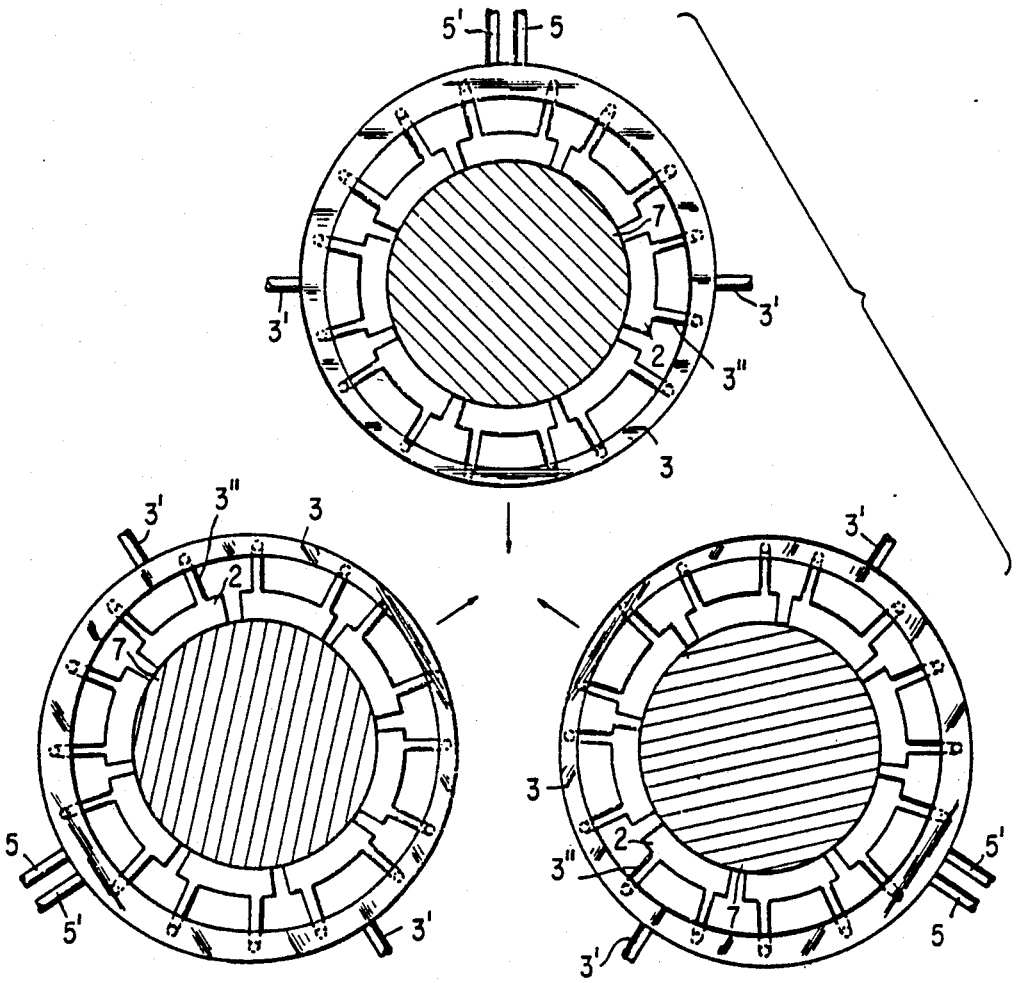
FIG. 5 is a cross-sectional view showing the relationship of 3 current feed elements as shown in FIG. 2 in a furnace.

FIGS. 3 and 4 show a current feed element 3 in the form of hollow tubes 6. The hollow tubes 6 in the embodiment of FIGS. 3 and 4 have the same cross sectional dimensions as the current feed conductors 3' and the current conductors 3'' in the embodiment of FIGS. 1 and 2. The current conductors 3'' are of equal lengths to the maximum extent possible, and they are concentrically run predominantly parallel to the axis of the electrode 1 at a distance from the exterior surface of the electrode 1.

At their ends, each current conductor 3'' is fastened to an associated one of the contact jaws 2 on the side turned away from the electrode 1. The contact jaws 2 in turn are pressed onto the electrode 1 by the clamping elements 7. The current feed conductors 3' are run to the hollow tubes 6 approximately radially to the axis of the electrode 1, which is to say at a right angle to the furnace axis. Half of the current feed conductors 3' extend from each side. As with the embodiment of FIGS. 1 and 2, the current feed element (in this case consisting of the hollow tubes 6) has a larger current-conducting cross-section on the side remote from the furnace axis (i.e., away from the direction indicated by the arrow A) than on the side adjacent the furnace axis. At least one current conductor 3'' is allocated to each contact jaw 2. In the case of water-cooled contact jaws 2, two current conductors 3'' each (for forward and backflow of the cooling medium) are arranged per contact jaw 2. The cooling medium feed occurs through the current feed conductors 3' and the hollow cables 6.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A current feed for an electrode of an electric smelting furnace which comprises a plurality of electrodes disposed around and parallel to the furnace axis, said current feed comprising:

(a) a current feed element which:
  (i) surrounds the electrode;
  (ii) is coaxial to the electrode; and
  (iii) has a larger current-conducting cross-section on the side of said current feed element remote from the furnace axis than on the side of said current feed element adjacent to the furnace axis;

(b) current feed conductors leading to said current feed element;

(c) a plurality of contact jaws which, during use of the current feed, are in electrical contact with the electrode; and (d) a plurality of current conductors providing electrical connection between said plurality of contact jaws and said current feed element.

2. A current feed as recited in claim 1 wherein said current feed element is made of copper.

3. A current feed element as recited in claim 1 wherein said current feed element contains channels.

4. A current feed as recited in claim 3 wherein said channels are connected to a water intake and to a water discharge.

5. A current feed as recited in claim 3 wherein the change in the current-conducting cross section of said current feed element is accomplished by change of the cross sectional area of said channels in said current feed element with unchanged wall thickness of said current feed element.

6. A current feed as recited in claim 5 wherein said channels exhibit a continuously changing cross sectional area in the circumferential direction.

7. A current feed as recited in claim 1 wherein said current feed element is formed by at least two current-conducting hollow cables.

8. A current feed as recited in claim 7 wherein:

(a) each end of each one of said at least two current-conducting hollow tubes is connected to one of said current feed conductors and the other end of each one of said at least two current conducting hollow tubes is connected to one of said current conductors;

(b) said at least two current-conducting hollow tubes have different lengths; and (c) said at least two current-conducting hollow tubes run concentrically around the electrode at a distance therefrom.

9. A current feed as recited in claim 8 wherein said at least two current-conducting hollow tubes are run close to one another on a maximum of two imaginary cylinder areas extending coaxially to the electrode.

10. A current feed as recited in claim 7 wherein the change of the current-conducting cross section of said at least two current-conducting hollow tubes is accomplished by varying the number of the hollow tubes.

* * * * *